United States Patent [19]

Hamby

[11] Patent Number: 4,909,172

[45] Date of Patent: Mar. 20, 1990

[54] BOAT BOTTOM PROTECTOR

[75] Inventor: William E. Hamby, HCR 64, Box 1036, Locust Grove, Okla. 74352

[73] Assignee: William E. Hamby, Locust Grove, Okla.

[21] Appl. No.: 192,207

[22] Filed: May 9, 1988

[51] Int. Cl.[4] ..... B62B 59/02

[52] U.S. Cl. ..... 114/219; 114/343

[58] Field of Search ..... 114/219, 343, 344, 357, 114/361; 293/126, 218; 296/41, 188, 199; 428/200, 202

[56] References Cited

U.S. PATENT DOCUMENTS

| | | | |
|---|---|---|---|
| 3,055,022 | 9/1962 | Vallquist | 114/219 |
| 3,220,026 | 11/1965 | Lichti | 114/219 |
| 3,261,320 | 7/1966 | Leonard | 114/219 |
| 3,270,701 | 9/1966 | Kubas | 114/219 |
| 4,586,451 | 5/1986 | Mori | 114/219 |
| 4,751,891 | 6/1988 | Wilson | 114/219 |
| 4,762,080 | 8/1988 | Pearson | 114/343 |

*Primary Examiner*—Sherman D. Basinger
*Assistant Examiner*—Stephen P. Avila

[57] ABSTRACT

A boat protection device means for protecting the bottom of a boat is disclosed, the device comprising an elongated strip of flexible resilient solid material having a pair of flexible opposed walls diverging upwardly and outwardly from the central longitudinal axis of the strip and an adhesive for securing the opposed walls to the bottom of the boat.

1 Claim, 1 Drawing Sheet

BOAT BOTTOM PROTECTOR

FIELD OF THE INVENTION

The present invention relates to boats. In a more specific aspect the present invention relates to a bottom protector for boats. In yet another aspect the present invention relates to an article of manufacture which can be readily applied to the bottom of a wide variety of boats to protect the bottom of the boat, particularly in the bow area, from damage due to collision with rocks, pipes, and other solid obstacles which tend to damage the bottom of the boat.

BACKGROUND OF THE INVENTION

It is a common experience of all boaters, whether they have fiberglass or metal bottomed boats, to occasionally be in a situation where the bottom of the boat is brought into forcible contact with a rocky shore line, a submerged pipe or log, or some other solid object which could damage the bottom of the boat. The area of the boat that is particularly susceptible to such damage is the lowermost portion of the bow area. In most boats the bow area has a least one V-shaped portion which extends downward farther than the adjoining parts of the bow. These V-shaped areas are particularly susceptible to being damaged when they are brought into forcible contact with solid objects such as the rocky shores upon which they must be occasionally landed.

An object of the present invention is to provide a readily applied bottom protector that is useful for protecting the bottom of boats having a wide variety of bottom configurations.

Another object of the present invention is to provide a boat bottom protector which is capable of protecting the bottom of the boat from abrasion and impacts.

Still another object of the present invention is to provide a protector-boat assembly which will result in a boat having greater resistance to bottom damage.

Other aspects, objects, and advantages of the present invention will be apparent from the following description taken in conjunction with the drawings.

SUMMARY OF THE INVENTION

In accordance with the present invention there is provided an elongated strip of flexible resilient material including (a) a pair of opposed walls diverging upwardly and outwardly from the longitudinal axis of said strip to form a generally V-shaped hollow, said walls being flexible enough to be at least partly conformed to a V-shaped portion of the bottom of a boat and (b) adhesive means for securing the inside portion of said opposed walls of said strip to the bottom of a boat.

DETAILED DESCRIPTION OF THE INVENTION

The bottom protector of the present invention can be made of any suitable flexible resilient material. Examples of such materials include closed cell polyurethane, styrene-butadiene thermoplastic elastomers, natural rubber, chloroprene elastomers, polycarbonate elastomers, and the like. A particularly preferred material is known as polyester MDI polyurethane, especially when having a Shore A hardness of about 70. Most preferrably the material selected is one that is both resilient and resistant to abrasion.

The adhesive means for securing the protector strip to a boat can likewise be of any suitable material. Thus it can comprise a strip of suitable adhesive material in amounts sufficient to insure that the strip will remain bonded to the boat when the boat is propelled through water. The particular adhesive means employed will obviously vary somewhat depending upon the particular material used in making the strip and the material used in making the boat bow. Examples of adhesive materials include epoxy resins, polyurethane resins, butyl type, polysulfide elastomers, elastomeric butadiene homopolymers, elastomeric styrene-butadiene copolymers, polycarbonate polymers, and the like.

In a particularly preferred embodiment at least one strip of adhesive extends along the total length of the inside of each wall portion of the protective strip and said strips of adhesive are initially covered with a strip of pressure-relief tape which protects the adhesiveness of the adhesive strip until such time as the protective strip is to be applied to a boat. At that time the relief tape would be stripped off to expose active adhesive which could the bind the protective strip to the bottom of a boat.

In another preferred embodiment the adhesive means includes at least one strip of butyl tape which extends along the total length of the inside of each wall at a point near the outer end of said wall. The butyl tape is of the same type that the currently used in installing automobile windshields. It is also within the scope of the invention to include adhesive in the area of the point of the generally V-shaped hollow of the protector strip. For example, one could employ a strip of the aforementioned butyl tape along the central axis of the protector strip in the area of the point of the generally V-shaped hollow of said protector strip.

Figure 1:
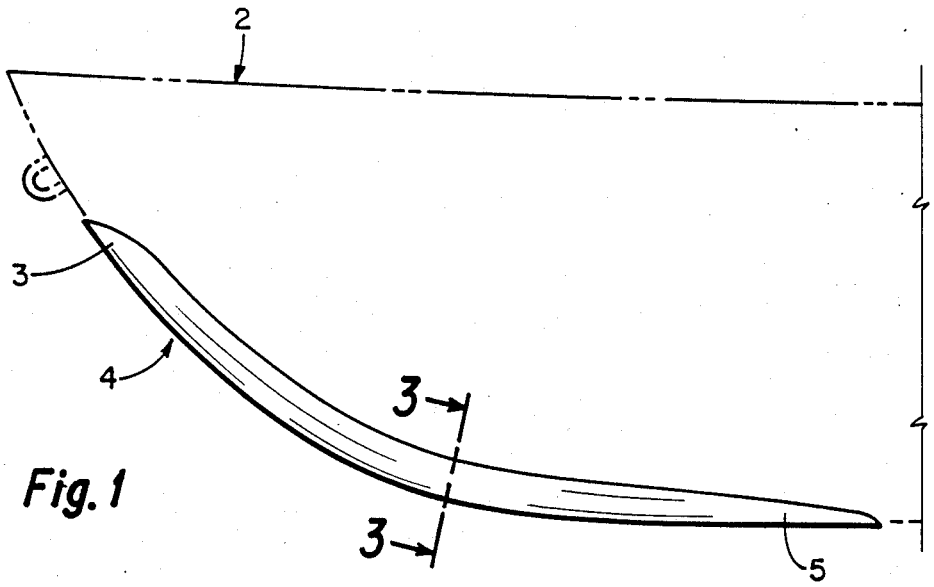
FIG. 1 is a side view of a fragment of the bow of a boat having an embodiment of the present invention secured thereon.
Figure 2:
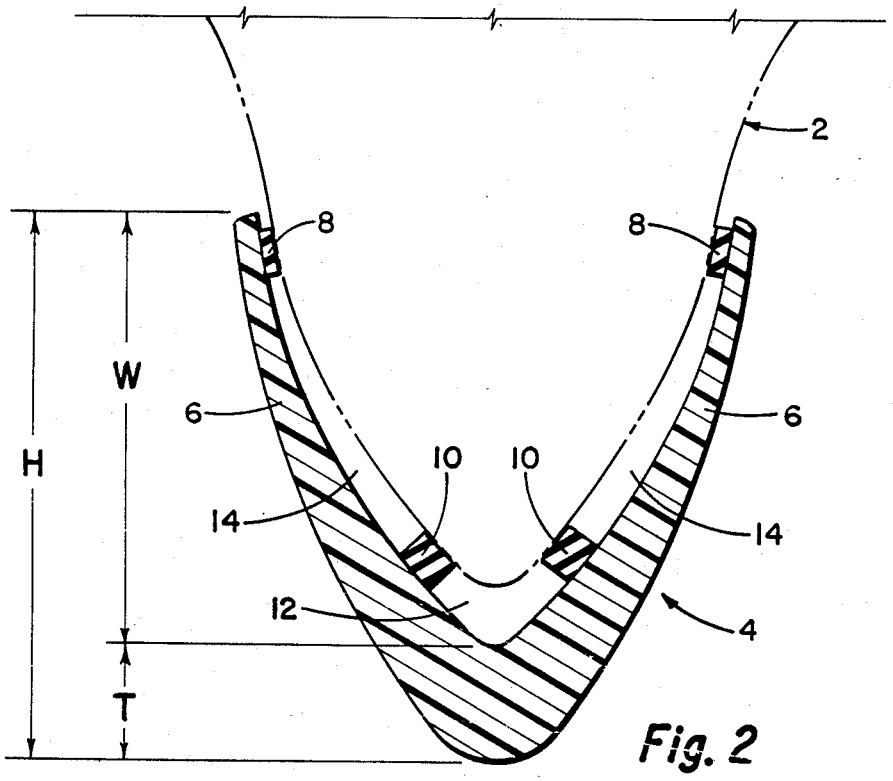
FIG. 2 is a diagramatical illustration of a cross-section of the protector-boat assembly taken across lines 3—3 of FIG. 1.

FIGS. 1 and 2 provide an illustration of a preferred embodiment of the present invention. FIG. 1 illustrates a portion of the bow 2 of a boat having V-shaped bow portion. The bottom of protector strip 4 is secured to the bottom of the bow 2 in the area that is particularly susceptible to damage.

Although the bottom protector strip 4 could conceivably be of any suitable length, it is generally preferred to have the strip be of a length in the range of about 2 to about 8 foot, still more preferably about 4 to about 6 foot.

FIG. 2 is a diagramatical illustration of how the protecting strip 4 can be secured to the bottom of the boat bow 2. In this particular embodiment, the outer end of each wall 6 of the protective strip 4 includes along its length a strip of ⅛ by ¼ inch butyl tape 8. At a lower portion of each wall 6 of the protective strip 4 there is another strip of butyl tape 10, in this case a ¼ inch square butyl tape. The arrangement illustrated in FIG. 2 allows for an air space 12 to be left between the strip and the bottom of the bow. The air space 12 provides an additional shock-absorbing capability. It should be noted that the actual dimensions in FIG. 2 have been somewhat exaggerated for the purpose of illustration.

In a particularly preferred embodiment, the area 14 between the tape strips 8 and 10 on each wall of the protector strip 4 is filled with an adhesive. Typically an adhesive capable of curing in the absence of air would be preferred for use in the area 14. An example of such an adhesive would be an anaerobic two-part polyurethane adhesive mixture.

Typically, before being applied to a boat, the strip would have dimensions such that the dimension W of FIG. 2 would be in the range of about 2 to about 5 inches, the dimension H would be in the range of about 2 to about 6 inches, and the dimensions T would be in the range of about ¼ to about 1 inch. Also, before the protector strip is applied to a boat, it is preferable that the length of said strip have a curvature somewhat similar to that present in the bow area of most boats. A typical degree of curvature would be in the range of about 0.3 inches of rise per inch of length of the protector strip. For example, a protector strip about 5 and one-half feet long would have a degree of curvature such that the distance between an imaginary line drawn tangent to the bottom of the strip at one end and the other end would be about 20 inches.

In the embodiment illustrated in FIG. 1, it should be noted that the height of the walls of the fore-end portion 3 of the strip 4 and the aft-end portion 5 of the strip 4 decreases so that the ends of the strip are basically a flat surface having a relatively rounded end. Typically the height of the walls of the fore-end 3 increase gradually from the fore-end to a point about 3 to 6 inches from the fore-end of the strip 4 and the walls of the aft-end of the strip 4 increase gradually from the aft-end of the strip 4 to a point about 8 to about 12 inches from the aft-end of the strip 4.

While the present invention has now been described both broadly and with reference to some specific embodiments, it should be clear that there are many modifications and variations that can be made by one having had the benefit of this disclosure without departing from the spirit and scope of the present invention.

What is claimed is:

1. A boat bottom protector to provide resistance to abrasion and impacts comprising an elongated strip of flexible resilient solid material about 2 to about 8 foot in length having a pair of opposed walls diverging upwardly and outwardly from substantially all of the length of the longitudinal axis of said strip to form a generally V-shaped hollow, the thickness of said walls increasing from the outer tips of each said wall to the central longitudinal axis of said strip, wherein said strip in a free unbound state curves gradually upward from one end to the other, the vertical distance between the bottom of the strip and imaginary line extending from the outer tip of one of said walls to the outer tip of the other of said walls is in the range of about 2 to about 6 inches, and the distance between the outer tips of said opposed walls is in the range of about 2 to about 5 inches, the strip being bonded to a boat hull bottom with adhesive, the strip tapering at the front and top towards the bottom of the strip and tapering from the top to the bottom at the rear of the strip, the strip extending from adjacent the top of the hull bow to a flat portion of the hull bottom.

* * * * *